US012630389B2

(12) United States Patent
Bestland et al.

(10) Patent No.: US 12,630,389 B2
(45) Date of Patent: May 19, 2026

(54) OXYGEN TUBE APPARATUS

(71) Applicants: Marlin Bestland, Camp Verde, AZ (US); Lisa Birr, Camp Verde, AZ (US)

(72) Inventors: Marlin Bestland, Camp Verde, AZ (US); Lisa Birr, Camp Verde, AZ (US)

( * ) Notice: Subject to any disclaimer, the term of this patent is extended or adjusted under 35 U.S.C. 154(b) by 62 days.

(21) Appl. No.: 18/672,193

(22) Filed: May 23, 2024

(65) Prior Publication Data

US 2025/0361117 A1 Nov. 27, 2025

(51) Int. Cl.
*B65H 75/44* (2006.01)
*B65H 75/48* (2006.01)

(52) U.S. Cl.
CPC ..... *B65H 75/4463* (2013.01); *B65H 75/4421* (2013.01); *B65H 75/4428* (2013.01); *B65H 75/48* (2013.01); *B65H 2402/31* (2013.01); *B65H 2402/42* (2013.01); *B65H 2701/11214* (2013.01)

(58) Field of Classification Search
CPC ..... B65H 75/4463; B65H 75/4421; B65H 75/4428; B65H 75/48; B65H 2402/31; B65H 2402/42; B65H 2701/11214; B65H 16/08; B65H 57/14; B65H 2402/443; A61M 2202/0208; A61M 2209/08; A61M 2209/084
USPC ..... 137/355.12, 355.16, 355.2, 355.21, 137/355.22, 355.23, 355.26
See application file for complete search history.

(56) References Cited

U.S. PATENT DOCUMENTS 1,675,140 A * 6/1928 Schenderlein ..... B65H 75/4471 242/379.2
2,964,258 A * 12/1960 Kutil ..... B65H 75/4402 248/289.11
4,137,939 A * 2/1979 Chow ..... B65H 75/403 137/355.27
4,238,074 A * 12/1980 Coons ..... B65H 75/403 137/355.12
4,378,473 A * 3/1983 Noorigian ..... B65H 75/4428 439/4
4,793,376 A * 12/1988 Hare ..... B65H 75/4471 137/355.27
5,007,598 A * 4/1991 Spear ..... B65H 75/2281 242/395
5,101,082 A * 3/1992 Simmons ..... B65H 75/4471 200/61.15

(Continued)

FOREIGN PATENT DOCUMENTS

WO WO2018217949 11/2018

*Primary Examiner* — Craig M Schneider
*Assistant Examiner* — Andrew J Rost

(57) ABSTRACT

An oxygen tube apparatus for transporting a length of oxygen tubing and facilitating mobility of a user includes a platform. A pair of wheels is rotatably coupled to the platform. A handle is coupled to the platform. The handle extends upwardly from the platform to facilitate a user in moving the platform. A reel casing with an interior space is coupled to the handle. A reel is positioned within the interior space. A tube is coiled around the reel. The tube is fluidly couplable to an oxygen source. The tube is outwardly extendable from the reel casing through an aperture. An adaptor port coupled to the reel casing is aligned with the reel to fluidly couple an oxygen hose to the tube and to transfer oxygen from the oxygen source to the reel casing to facilitate a user in receiving oxygen from the oxygen source.

15 Claims, 12 Drawing Sheets

(56) References Cited

U.S. PATENT DOCUMENTS

| | | | | |
|---|---|---|---|---|
| 5,179,972 | A * | 1/1993 | Eley | B65H 75/4478 137/355.19 |
| 5,236,143 | A * | 8/1993 | Dragon | B65H 75/48 242/378.1 |
| 5,390,695 | A * | 2/1995 | Howard | B65H 75/4471 137/355.27 |
| 5,392,808 | A | 2/1995 | Pierce | |
| 5,520,212 | A * | 5/1996 | Williams | B65H 75/4478 137/355.27 |
| 5,758,685 | A * | 6/1998 | Tisbo | B65H 75/4478 137/355.27 |
| 6,416,009 | B1 * | 7/2002 | Iaciofano | B65H 75/4463 242/384.7 |
| 6,889,688 | B1 | 5/2005 | Wright | |
| 7,017,603 | B1 * | 3/2006 | Rosine | B65H 75/403 242/395.1 |
| D595,121 | S | 6/2009 | Murphy | |
| 7,857,000 | B1 * | 12/2010 | Langdon | B65H 75/38 137/355.27 |
| 9,403,662 | B1 | 8/2016 | Evans | |
| 9,969,412 | B2 * | 5/2018 | Jackson, Jr. | B62B 1/125 |
| 10,392,221 | B2 | 8/2019 | Davis, Jr. | |
| 2006/0243282 | A1 | 11/2006 | Sackman | |
| 2016/0354570 | A1 | 12/2016 | Arroyo | |
| 2017/0239011 | A1 | 8/2017 | Lucas | |
| 2018/0318542 | A1 | 11/2018 | Knowlson | |

* cited by examiner

OXYGEN TUBE APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to oxygen tubes and more particularly pertains to a new oxygen tube for transporting a length of oxygen tubing to facilitate mobility of a user.

(2) Description of Related Art Including Information Disclosed Under 37 CFR 1.97 and 1.98

The prior art relates to oxygen tubes. Oxygen tubes are typically attached to an oxygen source, such as an oxygen concentrator, to provide a user with a supply of concentrated oxygen. Oxygen concentrators are often large, heavy, and difficult to move. Some oxygen concentrators have wheels, but their size and weight still make the oxygen concentrators difficult to move. Thus, there is a need for a device that can store the oxygen tubing, and from which the oxygen tubing can be safely extended and retracted so that the user can access the supply of concentrated oxygen without moving the oxygen concentrator. Ideally, such a device would facilitate retraction of excess tubing into the device, so that the tubing does not tangle or create a tripping hazard.

BRIEF SUMMARY OF THE INVENTION

An embodiment of the disclosure meets the needs presented above by generally comprising a platform. A pair of wheels is rotatably coupled to the platform. A handle is coupled to the platform. The handle extends upwardly from the platform wherein the handle is configured to facilitate a user in moving the platform. A reel casing is coupled to the handle. The reel casing has an interior space. An aperture extends through the reel casing into the interior space. A reel is rotatably coupled to the reel casing. The reel is positioned within the interior space of the reel casing. A tube is coiled around the reel. The tube has a first end that is coupled to the reel. The tube has a second end that is distal to the first end. The second end is configured to be fluidly coupled to an oxygen source. The tube is outwardly extendable from the reel casing through the aperture. The reel is rotatable in a first direction to uncoil the tube for extension of the tube from the reel casing. The reel is rotatable in a second direction to coil the tube around the reel for retraction of the tube into the reel casing. An adaptor port is coupled to the reel casing. The adaptor port is aligned with the reel wherein the adaptor port is fluidly coupled to the first end of the tube. The adaptor port is configured to be coupled to an oxygen hose to fluidly couple the oxygen hose to the tube wherein the tube is configured to transfer oxygen from the oxygen source to the reel casing whereby the tube is configured to facilitate the user in receiving oxygen from the oxygen source.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
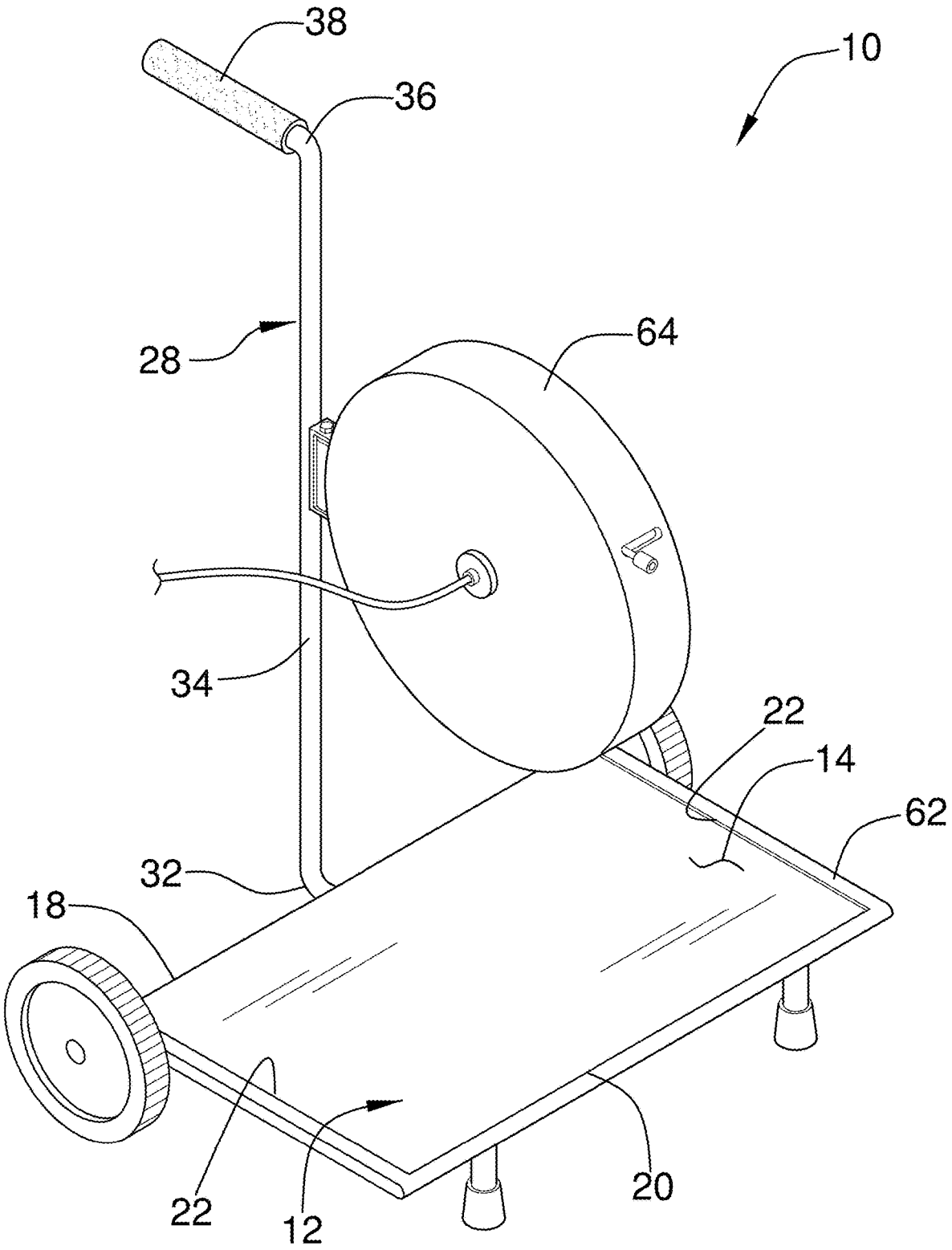
FIG. 1 is an isometric view of an oxygen tube apparatus according to an embodiment of the disclosure.

With reference now to the drawings, and in particular to FIGS. 1 through 13 thereof, a new oxygen tube embodying the principles and concepts of an embodiment of the disclosure and generally designated by the reference numeral 10 will be described.

As best illustrated in FIGS. 1 through 13, the oxygen tube apparatus 10 generally comprises a platform 12 that generally has a top side 14 and a bottom side 16. The platform 12 may also have a back edge 18, a front edge 20, and a pair of lateral edges 22. The top side 14 may be planar. The bottom side 16 may also be planar.

An axle 24 may be coupled to the platform 12. For example, the axle 24 may be positioned on the bottom side 16 of the platform 12. The axle 24 may be positioned on or proximate to the back edge 18 of the platform 12. The axle 24 may have a length exceeding a length of the back edge 18 of the platform 12.

A pair of wheels 26 may be rotatably coupled to the platform 12. The pair of wheels 26 may alternatively be rotatably coupled to opposing lateral ends of the axle 24. For example, each wheel of the pair of wheels 26 may be positioned adjacent to a respective lateral edge of the pair of lateral edges 22.

A handle 28 is coupled to the platform 12. The handle 28 extends upwardly from the platform 12. Alternatively, the handle 28 may be coupled to and extend upwardly from the axle 24. Coupling the handle 28 to the axle 24 may increase stability of the handle 28 on the platform 12. The handle 28 is generally positioned adjacent to the back edge 18 of the platform 12. The handle 28 may have a height between 0.91 meters, or 3.0 feet, and 1.5 meters, or 5.0 feet, wherein the handle 28 is configured to facilitate a user 30 gripping the handle 28 to move the platform 12. The handle 28 may be spaced equidistantly from each wheel of the pair of wheels 26.

The handle 28 may further include a handle first rod 32 that extends outwardly from the back edge 18 of the platform 12. Alternatively, the handle first rod 32 may extend outwardly from the axle 24. For example, the platform 12 may extend over and cover the handle first rod 32. In other embodiments, such as those shown in FIG. 1, or the handle first rod 32 may extend outwardly past the back edge 18 of the platform 12.

A handle second rod 34 may be coupled to the handle first rod 32. For example, the handle second rod 34 may be positioned distally to the platform 12 on the handle first rod 32. The handle second rod 34 generally extends upwardly from the handle first rod 32. The handle second rod 34 may be perpendicular to the handle first rod 32.

A handle third rod 36 may be coupled to the handle second rod 34. For example, the handle third rod 36 may be positioned distally to the handle first rod 32 on the handle second rod 34. The handle third rod 36 may extend outwardly away from the handle second rod 34 wherein the handle third rod 36 is configured to facilitate the user 30 in gripping the handle 28. For example, the handle third rod 36 may extend outwardly away from the platform 12. The handle third rod 36 may be angled upwardly and away from the handle second rod 34.

A grip sleeve 38 may be coupled to the handle third rod 36. The grip sleeve 38 may be hollow wherein the handle third rod 36 is positioned within the grip sleeve 38.

A frame 40 may be coupled to the axle 24. The frame 40 may extend outwardly from the axle 24 toward the front edge 20 of the platform 12. The frame 40 may be perpendicular to the axle 24. The frame 40 may be coplanar with the axle 24. The frame 40 may be positioned against the bottom side 16 of the platform 12 wherein the frame 40 supports the platform 12.

For example, the frame 40 may include a frame first shaft 42 that may be positioned proximate to a first lateral edge 44 of the pair of lateral edges 22. A frame second shaft 46 may be spaced from the frame first shaft 42. For example, the frame second shaft 46 may be positioned proximate to a second lateral edge 48 of the pair of lateral edges 22.

A support 50 may be coupled to the frame 40. The support 50 may extend downwardly from the frame 40. The support 50 may have a height that is complementary to a height of the pair of wheels 26 wherein the support 50 is configured to support the platform 12 levelly over a surface 52. For example, the surface 52 may including an outdoor ground surface or an indoor floor surface in an area where the user 30 is moving the platform 12. The support 50 may be positioned adjacent to the front edge 20 of the platform 12 wherein the support is spaced from the pair of wheels 26.

Figure 3:
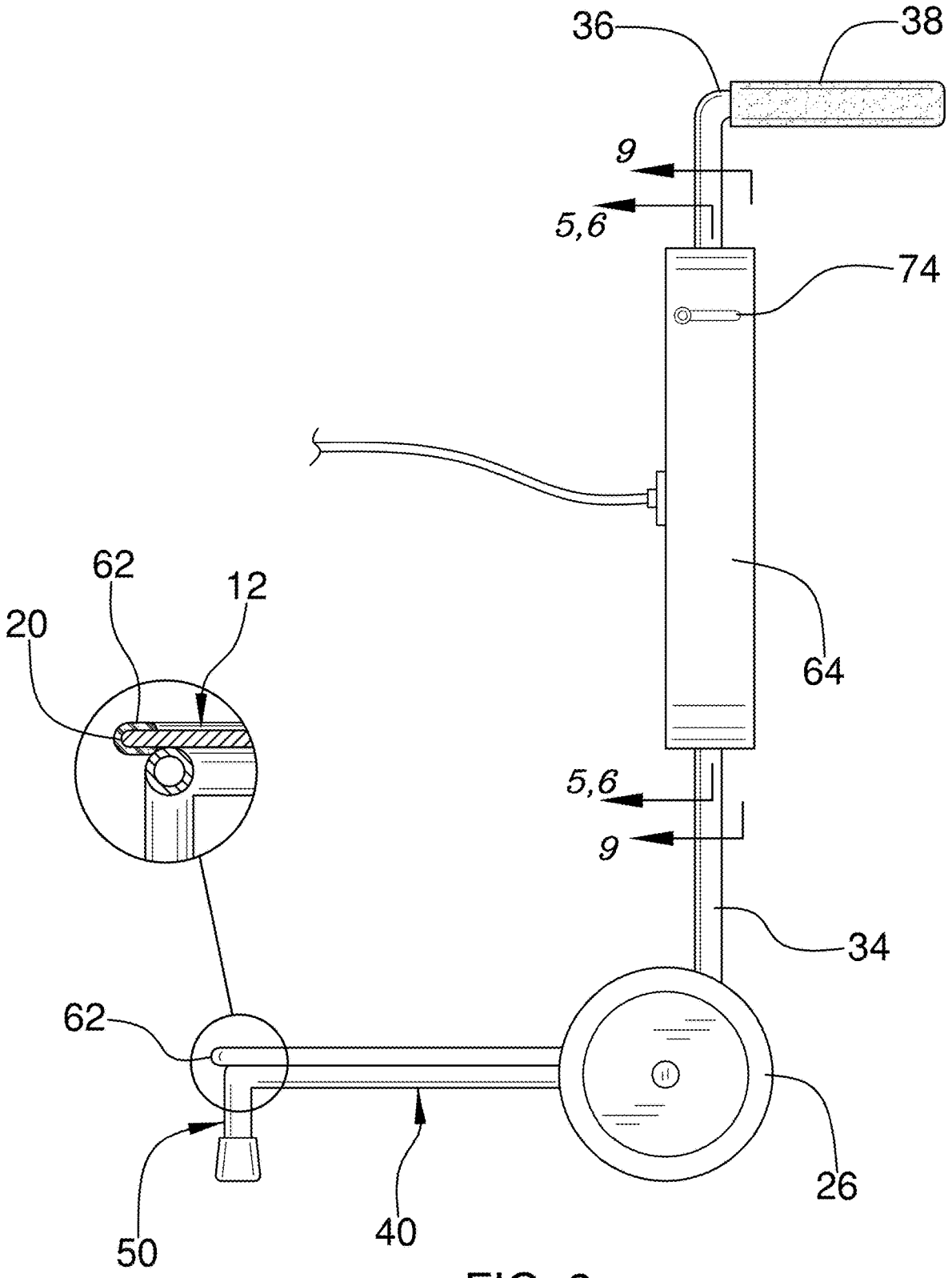
FIG. 3 is a side view of an embodiment of the disclosure.
Figure 4:
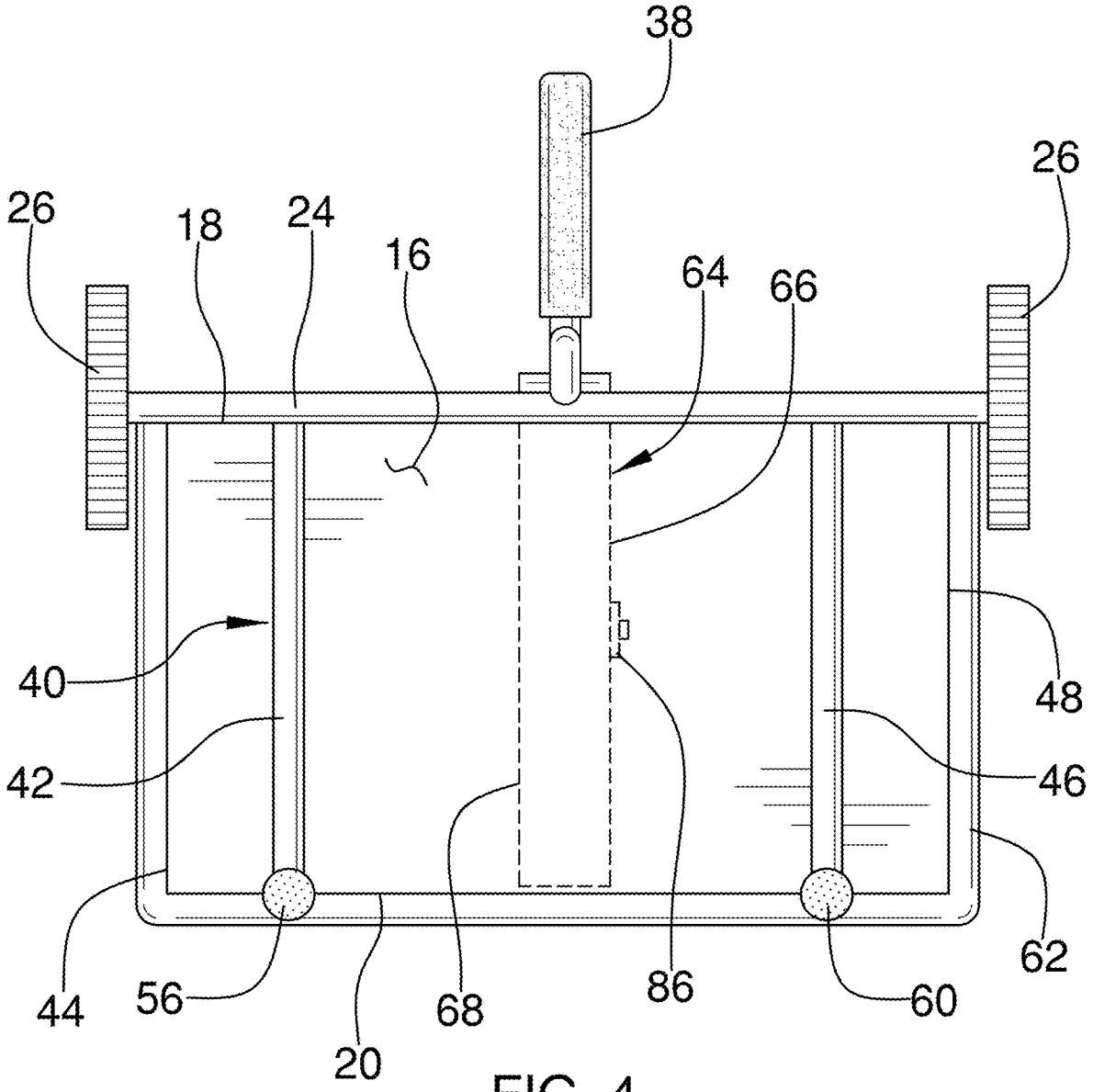
FIG. 4 is a bottom view of an embodiment of the disclosure.

For example, the support 50 may include a support primary pole 54 that is coupled to the frame first shaft 42. The support primary pole 54 may be perpendicular to the frame first shaft 42. A support secondary pole 58 may be coupled to the frame second shaft 46. The support secondary pole 58 may be perpendicular to the frame second shaft 46. As shown in FIG. 3, the support primary pole 54 and the support secondary pole 58 of the support 50 may have a height that is the same as the radius of the pair of wheels 26 wherein the support 50 is configured to support the platform 12 levelly over the surface 52.

A support primary foot 56 may be coupled to the support primary pole 54. For example, the support primary foot 56 may be positioned on the support primary pole 54 distally to the frame first shaft 42. The support primary foot 56 may be configured to stabilize a position of the platform 12 relative to the surface 52. For example, the support primary foot 56 may include a rubber material that is designed to increase friction between the surface 52 and the support primary pole 54.

A support secondary foot 60 may be coupled to the support secondary pole 58. For example, the support secondary foot 60 may be positioned on the support secondary pole 58 distally to the frame second shaft 46. The support secondary foot 60 may be configured to stabilize the position of the platform 12 relative to the surface 52. For example, the support secondary foot 60 may include a rubber material that is configured to increase friction between the surface 52 and the support secondary pole 58.

A bumper 62 may be coupled to the platform 12. For example, the bumper 62 may be positioned on one or more of the front edge 20 and each lateral edge of the pair of lateral edges 22 of the platform 12. The bumper 62 may have a U-shape that can be positioned around the front edge 20 and the pair of lateral edges 22 of the platform. As shown in FIG. 3, the bumper 62 may be coextensive with each lateral edge of the pair of lateral edges 22, wherein the bumper 62 extends to a junction between the pair of lateral edges 22 and the back edge 18. In other embodiments, the bumper 62 may extend along a partial length of each lateral edge of the pair of lateral edges 22, for example ending proximate to the pair of wheels 26. In such embodiments, the bumper 62 may stop just before the pair of wheels 26 to inhibit the bumper 62 from rubbing against the pair of wheels 26. The bumper 62 may include a resiliently compressible material wherein the bumper 62 is configured to inhibit the platform 12 from damaging objects. For example, when the platform 12 bumps into objects like furniture or walls as the user 30 moves throughout their home or other area, the bumper 62 may inhibit damage to those objects. The resiliently compressible material may include rubber, silicone, plastic, or other materials.

Figure 2:
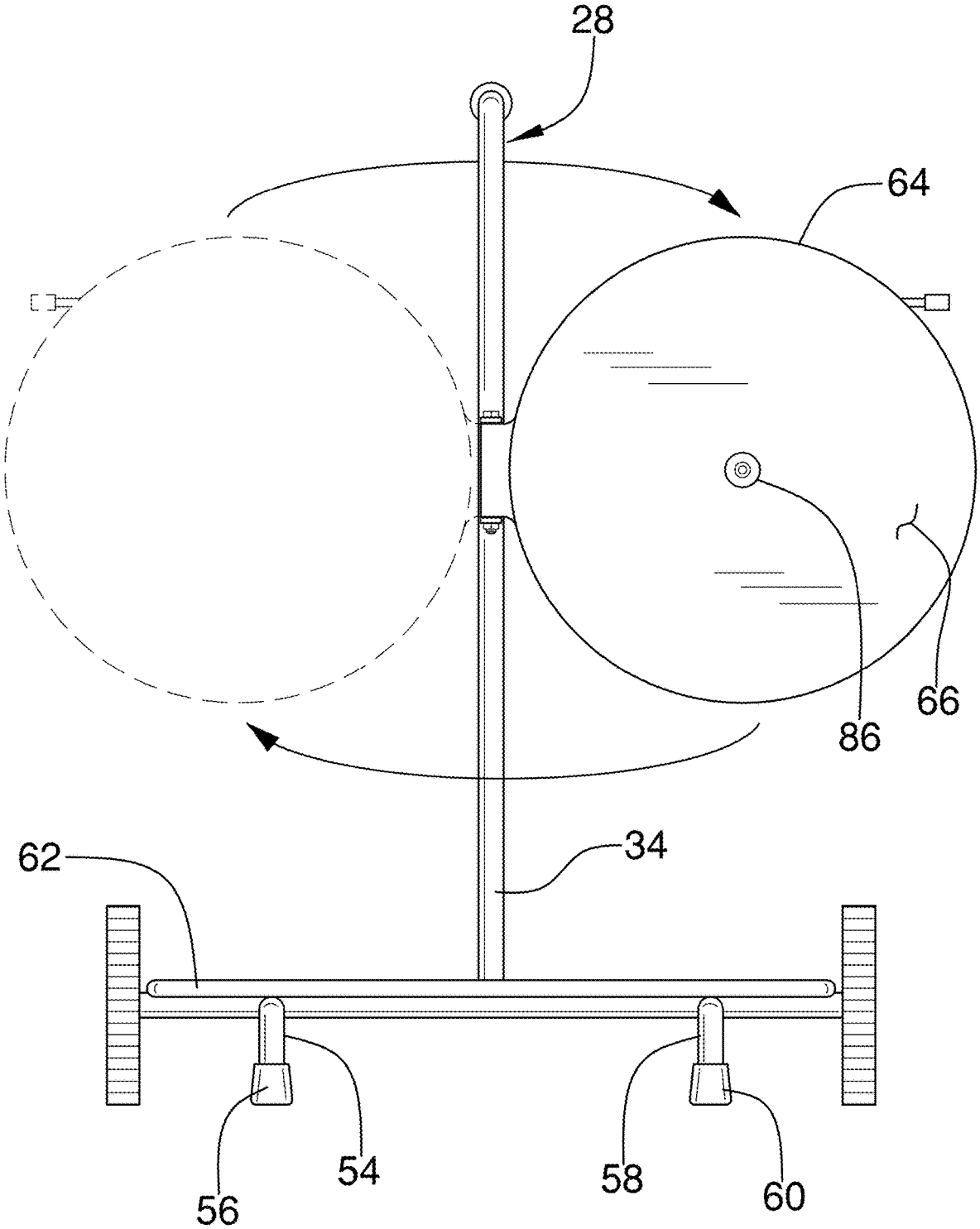
FIG. 2 is a front view of an embodiment of the disclosure.

A reel casing 64 is coupled to the handle 28. The reel casing 64 may have a front wall 66, a back wall 68, and a peripheral wall 70 that is coupled to and extends between the front wall 66 and the back wall 68 to define an interior space 72. The front wall 66 may be circular. The back wall 68 may be circular. The reel casing 64 is generally spaced from the platform 12 wherein the reel casing 64 is suspended from the handle 28 above the platform 12. The reel casing 64 may be pivotably coupled to the handle 28. For example, the reel casing 64 may be pivotable up to 180° around the handle 28, as shown in FIGS. 1 and 2.

An aperture 74 generally extends through the peripheral wall 70 of the reel casing 64. For example, the aperture 74 may be rectangular wherein the aperture 74 extends between the front wall 66 and the back wall 68 of the reel casing 64. The aperture 74 may be perpendicular to the front wall 66 and the back wall 68 of the reel casing 64.

A reel 76 is rotatably coupled to the reel casing 64. The reel 76 is generally positioned within the interior space 72 of the reel casing 64. The reel 76 may extend between the front wall 66 and the back wall 68. The reel 76 may be centrally positioned relative to each of the front wall 66 and the back wall 68.

A tube 78 is coiled around the reel 76 within the reel casing 64. The tube 78 generally has a first end 80 that may be coupled to the reel 76. The tube 78 has a second end 82 that is distal to the first end 80. The second end 82 is configured to be fluidly coupled to an oxygen source 84. For example, the second end 82 of the tube 78 may have an inner diameter that is between 3.18 millimeters, or 0.125 inches, and 12.7 millimeters, or 0.5 inches, or another size designed to complement a tube coupling of the oxygen source 84. In a preferred embodiment, the inner diameter may be 6.4 millimeters, or 0.25 inches, because that is a common sizing for the tube coupling of the oxygen source 84. In another example, the entire length of the tube 78, or substantially the entire length of the tube 78, may have the inner diameter that is designed to complement and couple to the tube coupling of the oxygen source 84. The oxygen source 84 may be an oxygen concentrator.

The tube 78 is outwardly extendable from the reel casing 64 through the aperture 74. For example, the reel 76 may be rotatable in a first direction to uncoil the tube 78 from the reel 76 for extension of the tube 78 from the reel casing 64. The reel 76 may be rotatable in a second direction to coil the tube 78 around the reel 76 for retraction of the tube 78 into the reel casing 64.

Figure 13:
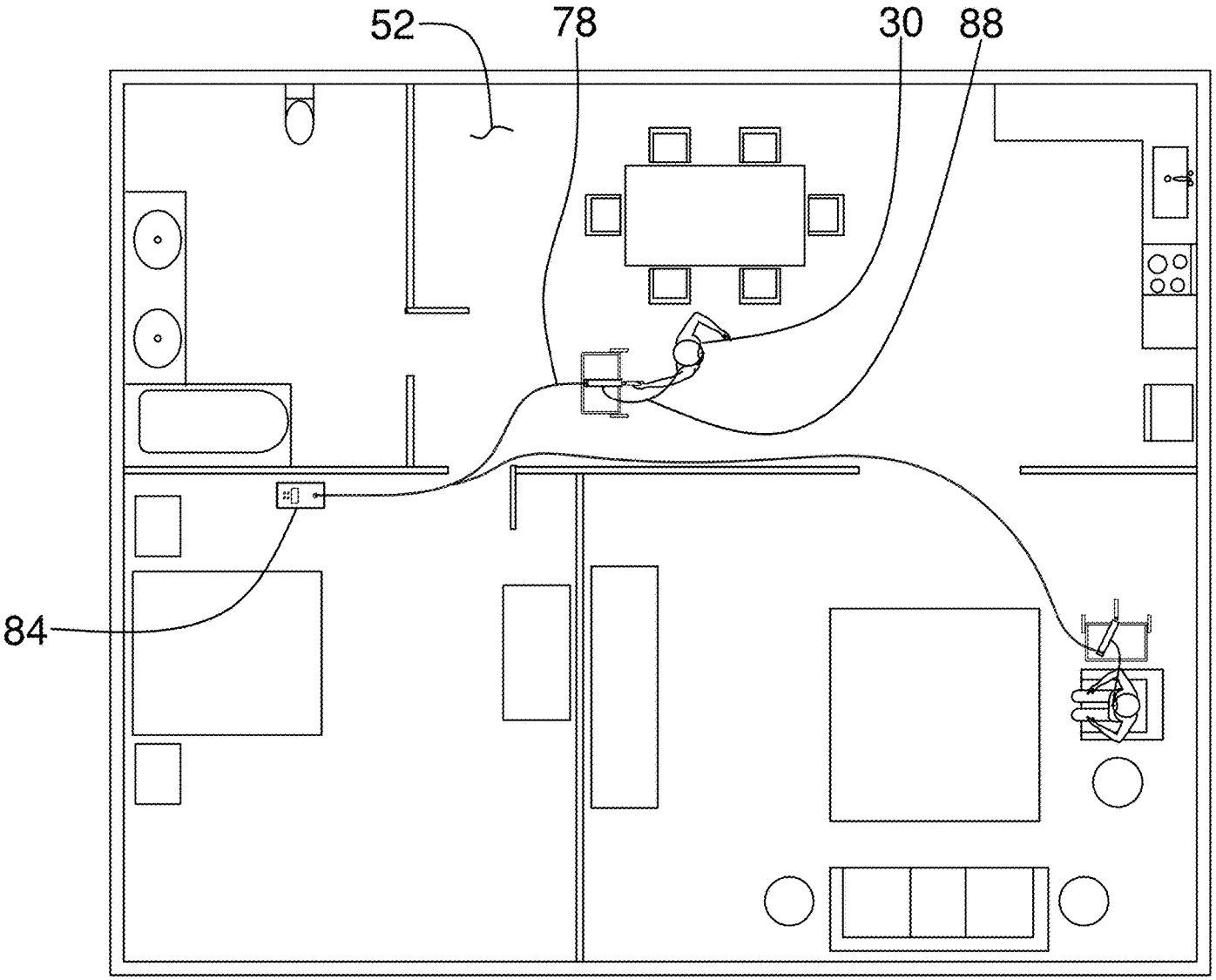
FIG. 13 is an in-use view of an embodiment of the disclosure.

The tube 78 may have a length between 12.2 meters, or 40.0 feet, and 18.3 meters, or 60.0 feet. For example, the tube 78 may have a length of 15.2 meters, or 50.0 feet. The tube 78 is designed to transfer oxygen from the oxygen source 84 to the reel casing 64. The tube 78 is configured to facilitate the user 30 in receiving oxygen from the oxygen source 84 when the user 30 is spaced from the oxygen source 84. For example, the oxygen source 84 may be positioned in a first room of a house of the user 30, while the user 30 and the reel casing 64 may be positioned in a second room of the house of the user 30. The tube 78 and the reel casing 64 thus provide the user 30 with increased mobility and eliminate the need to move the oxygen source 84 itself around the house of the user 30. Retraction of the tube 78 into the reel casing 64 can also inhibit the tube 78 from posing a tripping hazard to the user 30, for example because long lengths of the tube 78 are inhibited from being piled on the surface 52 on which the user 30 is walking. FIG. 13 provides an exemplary depiction of this increased mobility and safety afforded to the user 30.

An adaptor port 86 is coupled to the reel casing 64. The adaptor port 86 may extend through the front wall 66. The adaptor port 86 is generally aligned with the reel 76 wherein the adaptor port 86 is fluidly coupled to the first end 80 of the tube 78. The adaptor port 86 is configured to be coupled to an oxygen hose 88 to fluidly couple the oxygen hose 88 to the tube 78. For example, the oxygen hose 88 may have an inner diameter that is smaller than the inner diameter of the tube 78. The oxygen hose 88 is generally designed to transfer oxygen from the hose within the reel casing 64 to the user 30. The oxygen hose 88 may have a length between 0.91 meters, or 3.0 feet and 2.44 meters, or 8.0 feet. For example, the oxygen hose may have a length of 1.2 meters, or 4.0 feet, or a length of 2.1 meters, or 7.0 feet. The oxygen hose 88 is generally a medical hose that is used to deliver oxygen to the user 30.

A reel spring 90 may be coupled to the reel 76. The reel spring 90 may be coupled to the first end 80 of the tube 78. The reel spring 90 may wind around the reel 76 when the reel 76 rotates in the first direction to uncoil the tube 78 for extension of the tube 78 from the reel casing 64. The reel spring 90 may unwind from the reel 76 when the reel 76 rotates in the second direction to coil the tube 78 around the reel 76 for retraction of the tube 78 into the reel casing 64.

The reel spring 90 generally has a spring tension. The spring tension increases as the reel spring 90 winds around the reel 76. The spring tension is released when the reel spring 90 unwinds from the reel 76 wherein the reel spring 90 is configured to retract the tube 78 into the reel casing 64.

A tube lock 92 may be coupled to the reel casing 64. The tube lock 92 may releasably engage with the tube 78 wherein the tube lock 92 selectively inhibits the tube 78 from extending or retracting relative to the reel casing 64.

The tube lock 92 may include a pair of rollers 94. For example, the pair of rollers 94 may be rotatably coupled to the peripheral wall 70 of the reel casing 64. Each roller of the pair of rollers 94 is generally positioned on an opposing edge of the aperture 74 wherein the tube 78 slides between the pair of rollers 94 as the tube 78 extends and retracts relative to the reel casing 64. The pair of rollers 94 may grip the tube 78 when the tube 78 is pulled outward from the reel casing 64 wherein the pair of rollers 94 inhibit the tube 78 from retracting into the reel casing 64. The pair of rollers 94 may release the tube 78 when the tube 78 is pulled upward relative to the reel casing 64 to retract the tube 78 into the reel casing 64. For example, friction between the pair of rollers 94 and the tube 78 may inhibit the tube 78 from retracting into the reel casing 64 until the tube 78 is pulled upward. Pulling the tube 78 upward may space the tube 78 from one of the rollers of the pair of rollers 94, such that the friction-based grip is released and the reel spring 90 can retract the tube 78 into the reel casing 64.

Figure 5:
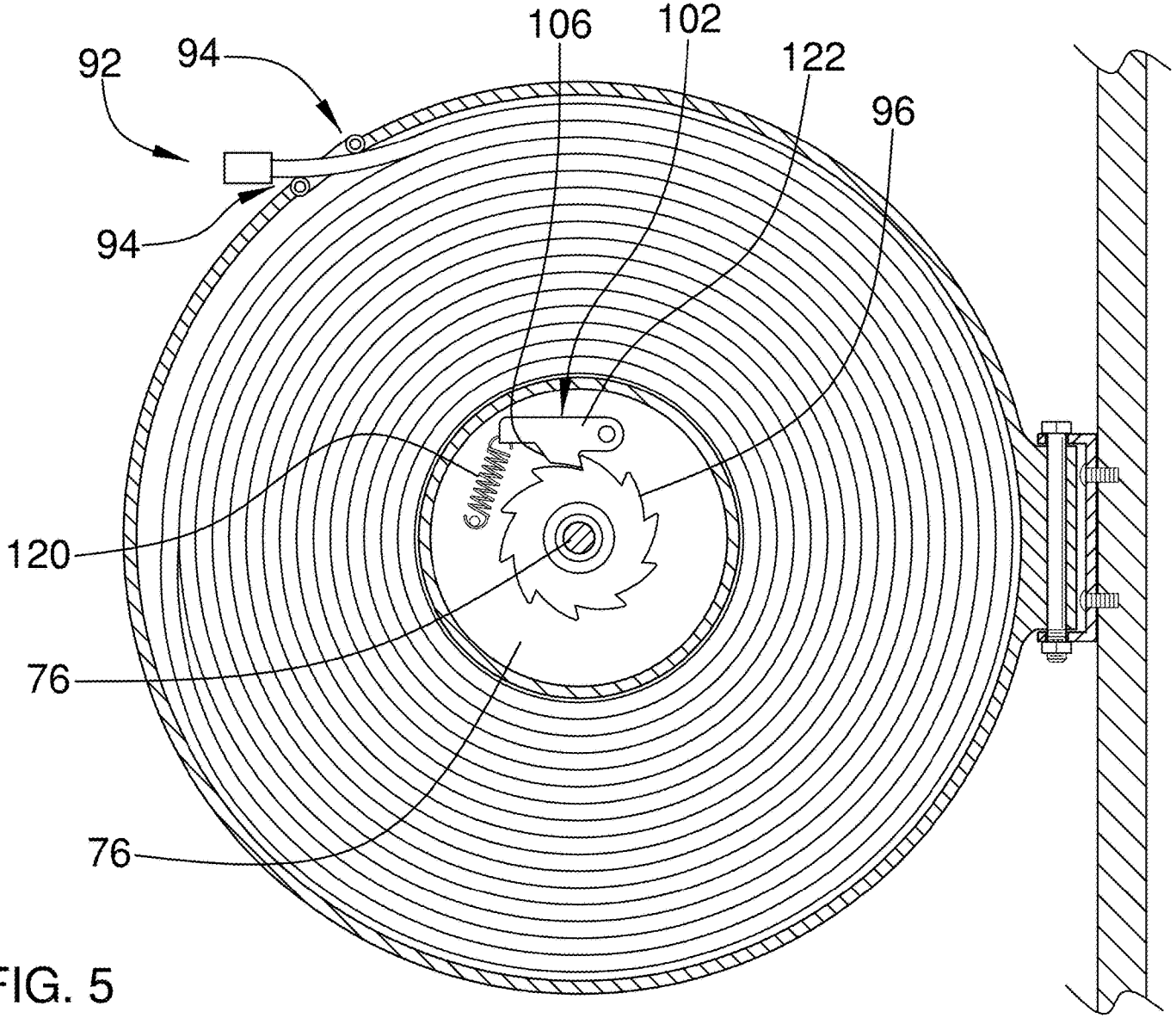
FIG. 5 is a cross-sectional view of an embodiment of the disclosure.

In some embodiments, a ratchet 96 may be positioned in the interior space 72 of the reel casing 64. For example, as shown in FIG. 5, the ratchet 96 may be positioned proximate to the reel 76. The ratchet 96 may be coupled to the reel 76, such that the ratchet 96 rotates when the reel 76 is rotated. The ratchet 96 may rotate in the first direction when the reel 76 rotates in the first direction. The ratchet 96 may rotate in the second direction when the reel 76 rotates in the second direction.

A locking pawl 102 may be pivotably coupled to the reel 76. The locking pawl 102 may include a main body 122 and a finger 106 that extends downwardly from the main body 122. The locking pawl 102 may be pivoted downwardly toward the ratchet 96 wherein the locking pawl 102 contacts the ratchet 96 to inhibit the ratchet 96 from being rotated in the second direction. When the ratchet 96 is inhibited from being rotated in the second direction, the reel 76 is inhibited from being rotated in the second direction to inhibit the tube 78 from being retracted into the reel casing 64.

The finger 106 contacts the ratchet 96 when the locking pawl 102 is pivoted downwardly to inhibit the ratchet 96 from rotating and to inhibit the tube 78 from retracting into the reel casing 64. The finger 106 is generally spaced from the ratchet 96 when the locking pawl 102 is pivoted upwardly, freeing the rotational movement of the ratchet 96 in the second direction.

A ratchet spring 120 may be coupled to the locking pawl 102. The ratchet spring 120 may be spaced from the finger 106, as shown in FIG. 5. The ratchet spring 120 is coupled to the reel 76. The ratchet spring 120 may pivot the locking pawl 102 upwards from the ratchet 96 to release the ratchet 96 so that the tube 78 can be retracted into the reel casing 64. For example, when the tube 78 is pulled upward, the ratchet spring 102 may pivot the locking pawl 102 upwards to space the finger 106 from the ratchet 96. The ratchet spring 120 may be biased to urge the locking pawl 102 downwardly toward the ratchet 96 when the tube 78 is pulled outward from the reel casing 64.

In some alternative embodiments, a lever may be coupled to the ratchet spring 120. The lever may be positioned on an external surface of the reel casing 64. To release the ratchet from the locking pawl 102, the user 30 may pivot the lever, which will move the ratchet spring 102 and pivot the locking pawl 102 upwards.

Figure 6:
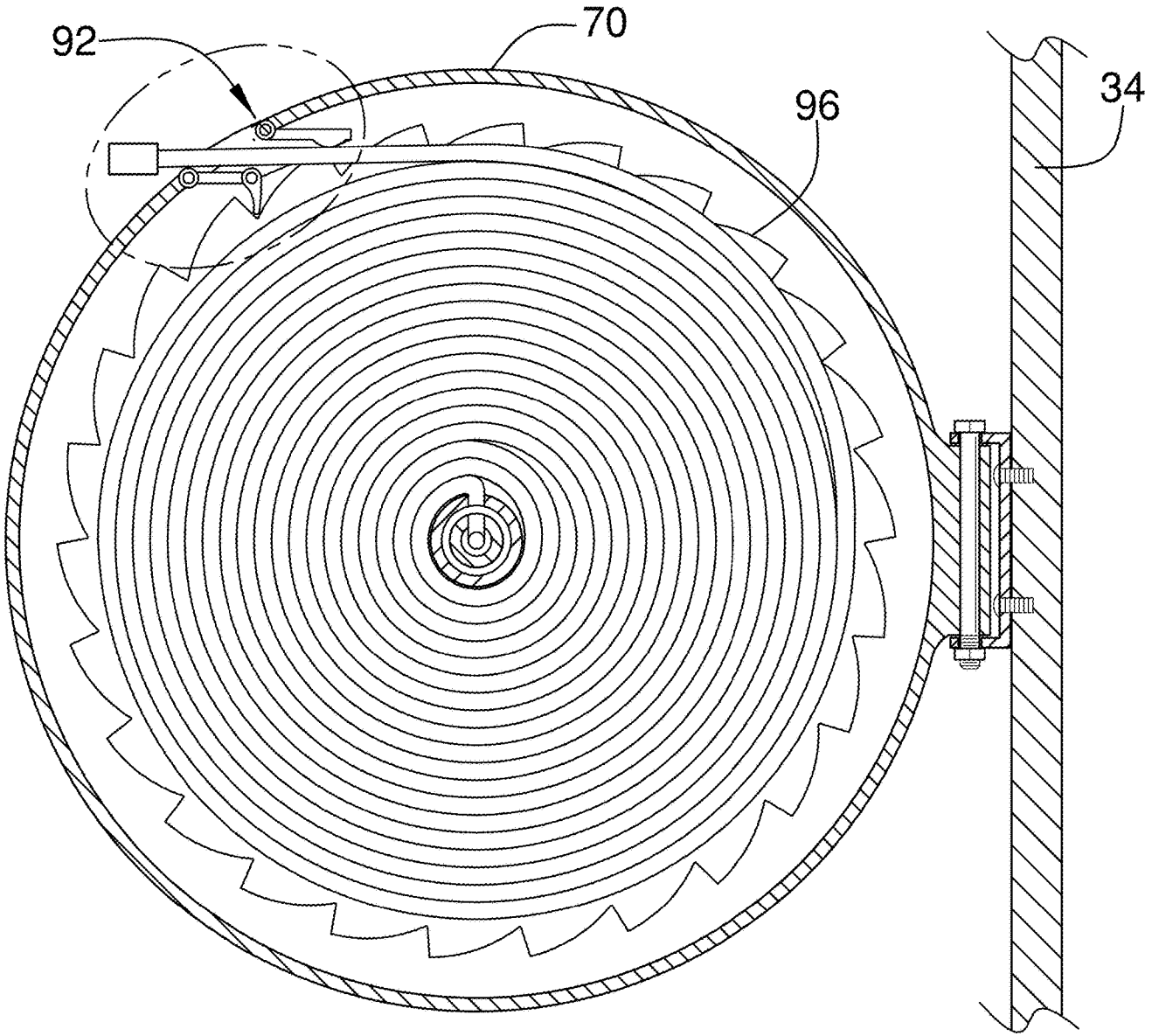
FIG. 6 is a cross-sectional view of an embodiment of the disclosure.
Figure 7:
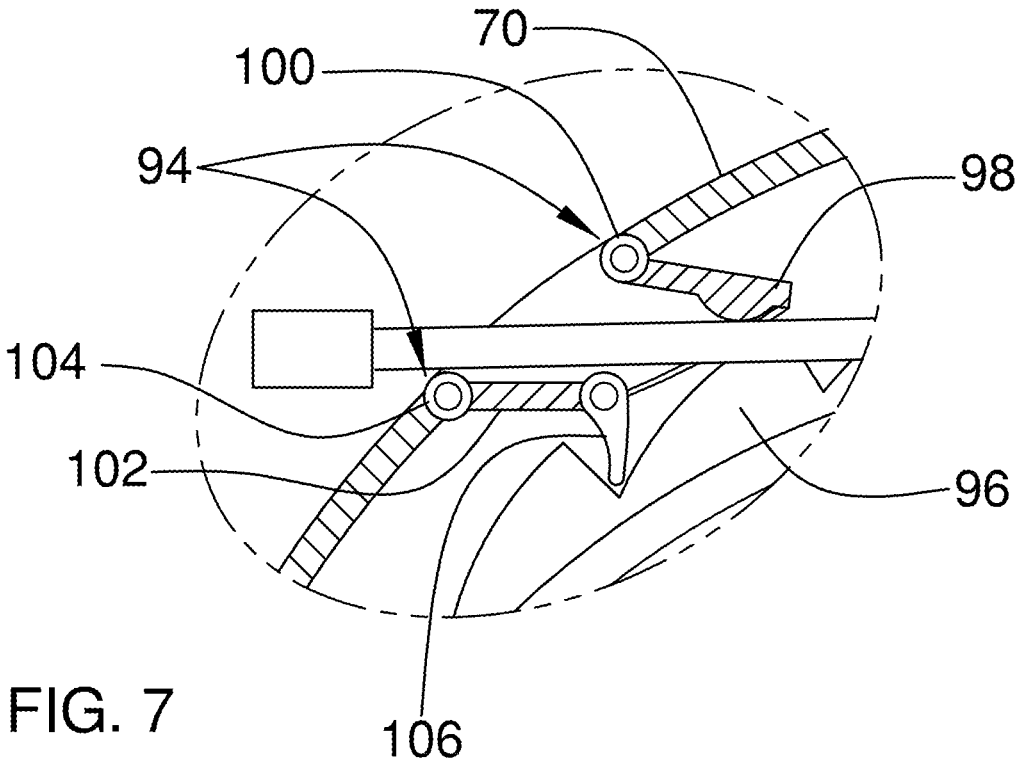
FIG. 7 is a detail view of an embodiment of the disclosure.
Figure 8:
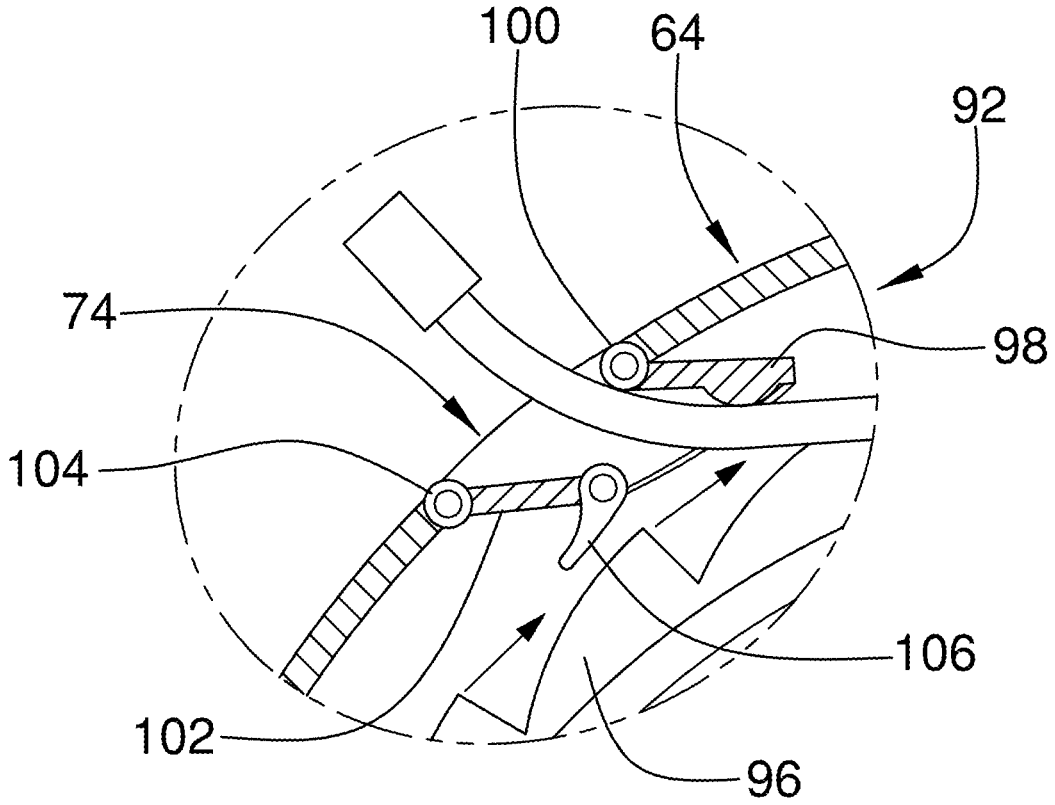
FIG. 8 is a detail view of an embodiment of the disclosure.
Figure 9:
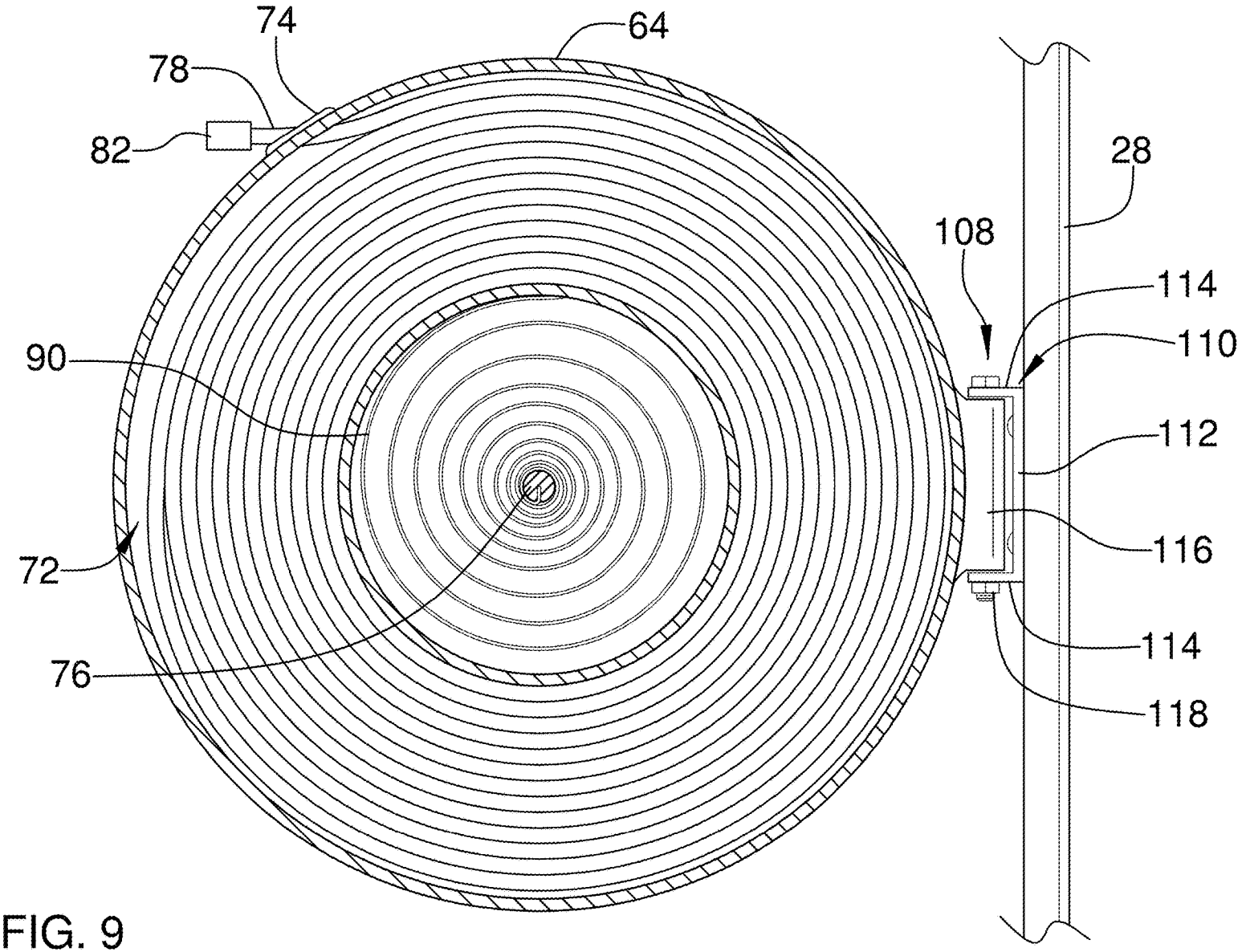
FIG. 9 is a cross-sectional view of an embodiment of the disclosure.

Alternatively, the ratchet 96 may be positioned adjacent to the peripheral wall 70, as shown in FIGS. 6-8. For example, a driving pawl 98 may be coupled to a first roller 100 of the pair of rollers 94. The driving pawl 98 may be positioned above the tube 78. The driving pawl 98 is generally pivotably coupled to the first roller 100 of the pair of rollers 94. The driving pawl 98 may contact the tube 78 wherein the driving pawl 98 is pivoted upwardly, for example when the tube 78 is pulled upward relative to the reel casing 64. The driving pawl 98 may be pivoted downwardly when the tube 78 is pulled outwardly from the reel casing 64.

The locking pawl 102 may be coupled to a second roller 104 of the pair of rollers 94. The locking pawl 102 may be positioned beneath the tube 78. The locking pawl 102 is generally pivotably coupled to the second roller 104 of the pair of rollers 94. The locking pawl 102 may be coupled to the driving pawl 98 wherein the locking pawl 102 pivots upwardly when the driving pawl 98 is pivoted upwardly and wherein the locking pawl 102 pivots downwardly to engage the ratchet 96 when the driving pawl 98 is pivoted downwardly. The locking pawl 102 secures a position of the ratchet 96 to inhibit the ratchet 96 and the reel 76 from rotating in the second direction when the locking pawl 102 is pivoted downwardly.

The finger 106 of the locking pawl 102 may be positioned distally to the second roller 104. The finger 106 contacts the ratchet 96 when the locking pawl 102 is pivoted downwardly to inhibit the ratchet 96 from rotating in the second direction, and to inhibit the tube 78 from retracting into the reel casing 64. The finger 106 is generally spaced from the ratchet 96 when the locking pawl 102 is pivoted upwardly, freeing the rotational movement of the ratchet 96 in the second direction.

A retainer 108 may be coupled to the reel casing 64. The retainer 108 is coupled to the handle 28. The retainer 108 pivotably secures the reel casing 64 to the handle 28 wherein the reel casing 64 is pivotable up to 180.0° around the handle 28. The retainer 108 may allow the reel casing 64 to pivot freely around the handle 28, so that the reel casing 64 can swing from a position in front of the handle 28, to positions on either side of the handle 28, as shown in FIGS. 1 and 2.

For example, the retainer 108 may include a bracket 110 that is mounted on the handle 28. The bracket 110 may have a bracket wall 112 that is aligned with, or parallel to, the handle 28. A pair of bracket lips 114 may be coupled to and extend forwardly from the bracket wall 110. The pair of bracket lips 114 are generally spaced from each other, for example being coupled to opposing lateral edges of the bracket wall 110. The pair of bracket lips 114 may be perpendicular to the bracket wall 110.

A reel casing projection 116 may be coupled to and extend outwardly from the reel casing 64. The reel casing projection 116 is pivotably coupled to the bracket 110. The reel casing projection 116 may be positioned between the pair of bracket lips 114. A fastener 118, such as a dowel or a screw, may pivotably couple the reel casing projection 116 to the bracket 110.

Figure 12:
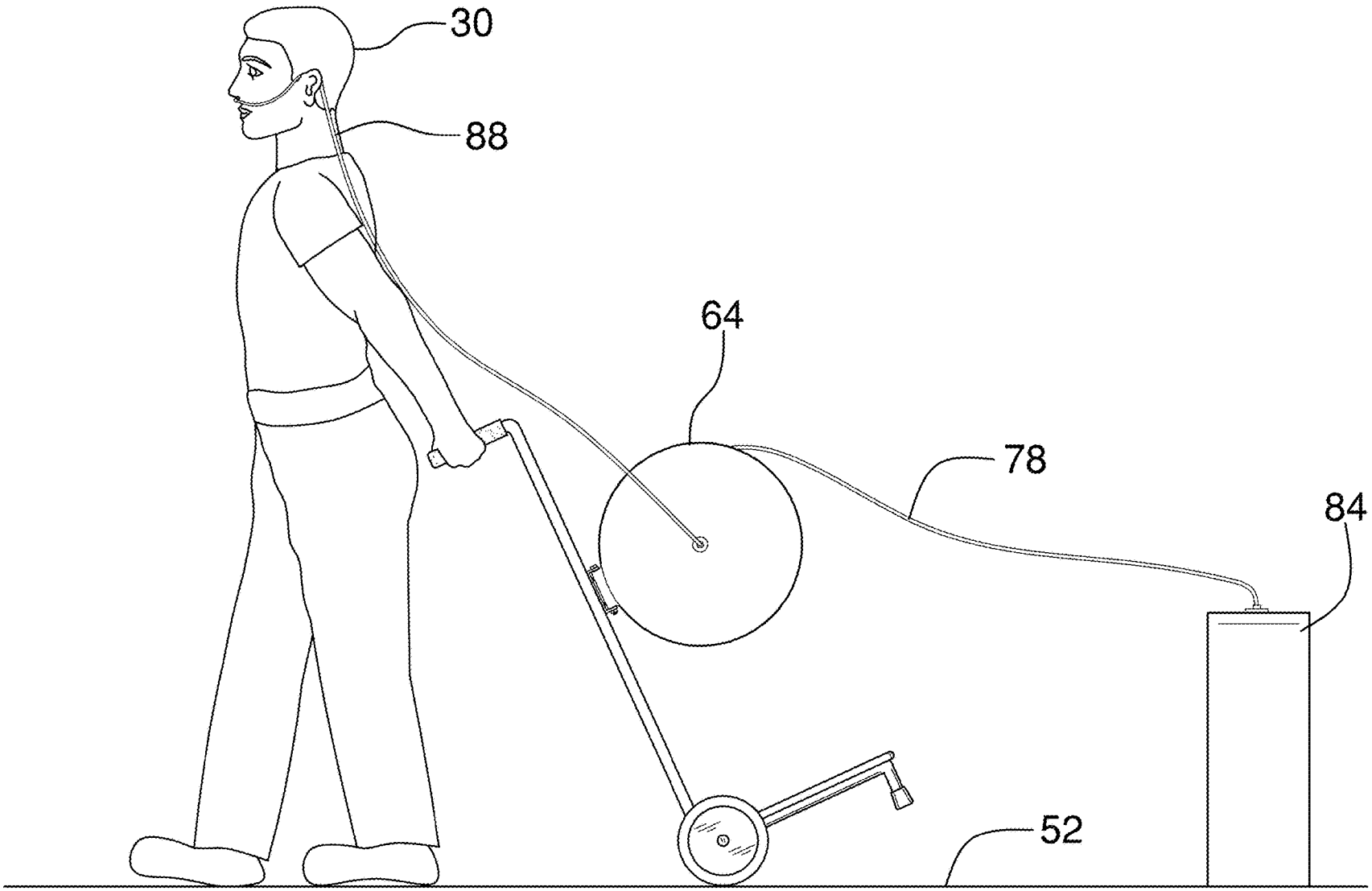
FIG. 12 is an in-use view of an embodiment of the disclosure.

In use, the user 30 may attach the second end 82 of the tube 78 to the oxygen source 84. As the user 30 moves around their house or other area, and away from the oxygen source 84, the tube 78 can be extended outwardly from the reel casing 64. When the user 30 moves closer to the oxygen source 84, the tube 78 may be retracted into the reel casing 64 so that the tube 78 does not remain on the floor to get tangled or to pose a tripping hazard for the user 30. The user 30 can thus move more freely around their house or other area, without needing to move the oxygen source 84 itself. FIGS. 12 and 13 show that the user 30 may pull the platform 12 behind them, such that the tube 78 is behind the user 30 and the user 30 has a clear field of vision.

Figure 10:
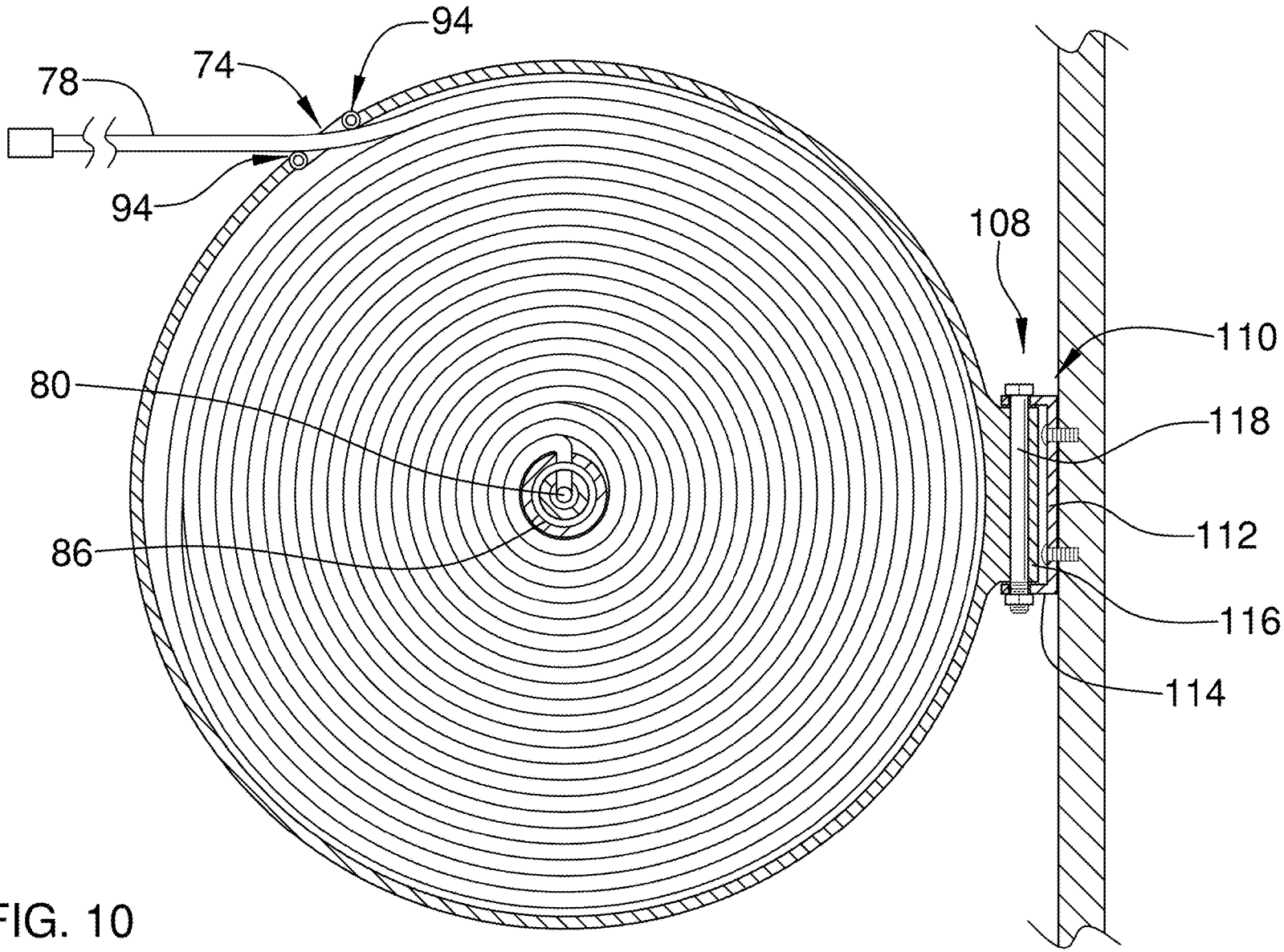
FIG. 10 is a cross-sectional view of an embodiment of the disclosure.
Figure 11:
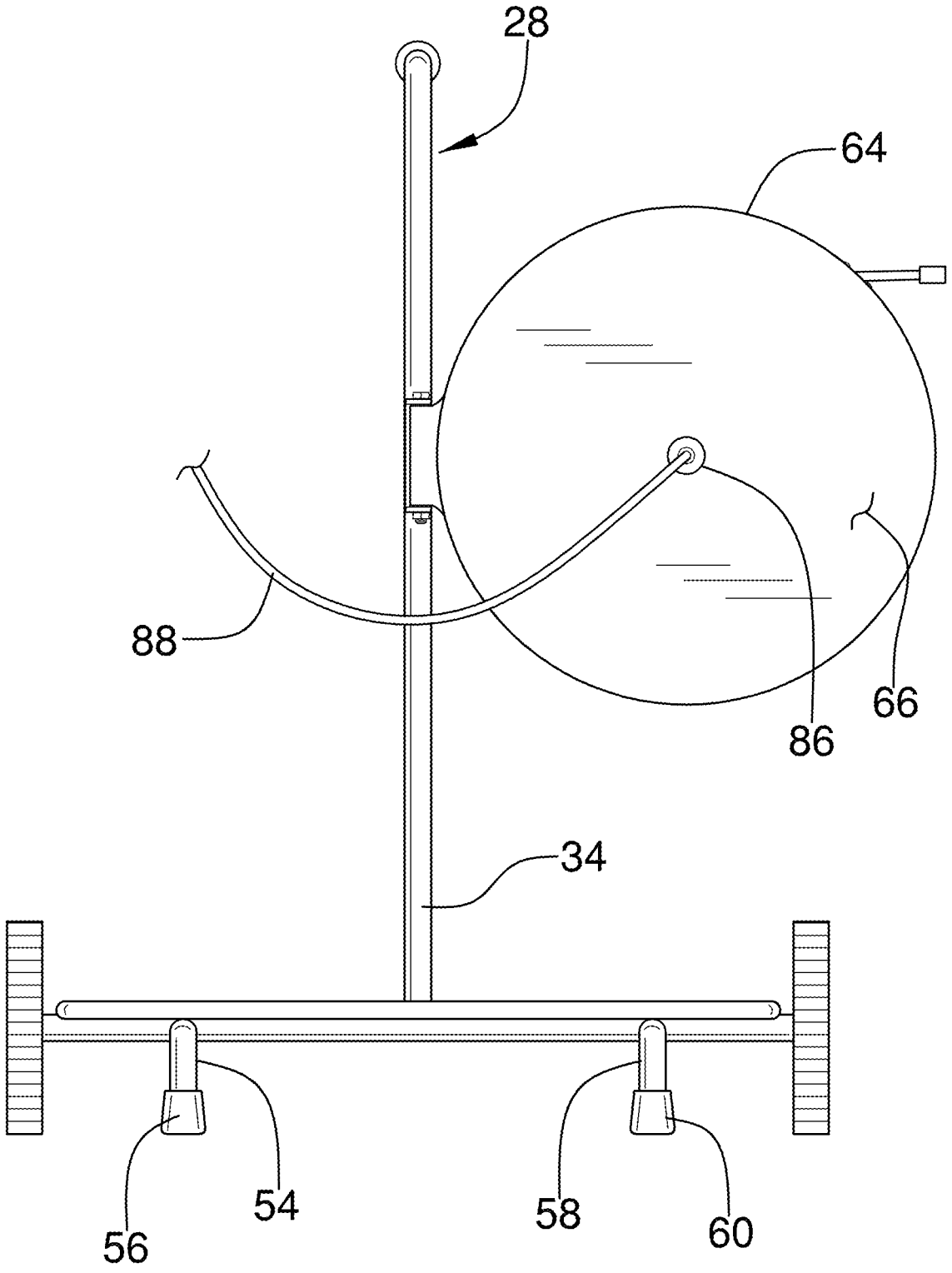
FIG. 11 is a front view of an embodiment of the disclosure.

The user 30 can attach their oxygen hose 88 to the adaptor port 86, so that the oxygen hose 88 can transfer the oxygen from the tube 78 into the nose of the user 30, as shown in FIG. 10. To inhibit their oxygen hose 88 from bending or folding, which can stop or slow the flow of oxygen to the user 30, the reel casing 64 may pivot around the handle 28.

The platform 12, frame 40, and support 50 help keep the reel casing 64 upright, or perpendicular to the surface 52, and suspended above the surface 52. The top side 14 of the platform 12 may be planar to facilitate the user 30 in transporting other objects, or to provide storage space for the user 30. For example, the user 30 could place books, dishes, or other objects on the platform 12 when moving between rooms, instead of carrying those objects while pulling the oxygen tube 78 apparatus. The bumper 62 will inhibit the platform 12 from damaging furniture, walls, or other objects and surfaces as the user 30 moves the oxygen tube 78 apparatus around their house or other area.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. A retractable oxygen hose assembly comprising:

a platform;

a pair of wheels being rotatably coupled to the platform;

a handle being coupled to the platform, the handle extending upwardly from the platform wherein the handle is configured to facilitate a user in moving the platform;

a reel casing being coupled to the handle, the reel casing having an interior space;

an aperture extending through the reel casing into the interior space;

a reel being rotatably coupled to the reel casing, the reel being positioned within the interior space of the reel casing;

a tube being coiled around the reel, the tube having a first end being coupled to the reel, the tube having a second end being distal to the first end, the second end being configured to be fluidly coupled to an oxygen source, the tube being outwardly extendable from the reel casing through the aperture, the reel being rotatable in a first direction to uncoil the tube for extension of the tube from the reel casing, the reel being rotatable in a second direction to coil the tube around the reel for retraction of the tube into the reel casing;

an adaptor port being coupled to the reel casing, the adaptor port being aligned with the reel wherein the adaptor port is fluidly coupled to the first end of the tube, the adaptor port being configured to be coupled to an oxygen hose to fluidly couple the oxygen hose to the tube wherein the tube is configured to transfer oxygen from the oxygen source to the reel casing whereby the tube is configured to facilitate the user in receiving oxygen from the oxygen source; and a tube lock being coupled to the reel casing, the tube lock being releasably engageable with the tube wherein the tube lock selectively inhibits the tube from being extended or retracted relative to the reel casing, the tube lock including:

a pair of rollers being rotatably coupled to the reel casing, the pair of rollers being positioned on opposing edges of the aperture wherein the tube slides between the pair of rollers as the tube extends and retracts relative to the reel casing, the pair of rollers gripping the tube when the tube is pulled outward from the reel casing wherein the pair of rollers inhibit the tube from being retracted into the reel casing, the pair of rollers releasing the tube when the tube is pulled upward relative to the reel casing to retract the tube into the reel casing;

a ratchet being positioned in the interior space of the reel casing, the ratchet being coupled to the reel wherein the ratchet rotates in the first direction when the reel rotates in the first direction and wherein the ratchet rotates in the second direction when the reel rotates in the second direction;

a locking pawl being pivotably coupled to the reel, the locking pawl being pivoted downwardly toward the ratchet to inhibit the ratchet from being rotated in the second direction; and a ratchet spring being coupled to the reel, the ratchet spring being coupled to the locking pawl wherein the ratchet spring pivots the locking pawl upwards when the tube is pulled upward relative to the reel casing, the locking pawl being spaced from the ratchet when the locking pawl is pivoted upwards to enable rotation of the ratchet in the second direction.

2. The retractable oxygen hose assembly of claim 1, further comprising a bumper being coupled to the platform, the bumper including a resiliently compressible material wherein the bumper is configured to inhibit the platform from damaging objects.

3. The retractable oxygen hose assembly of claim 1, wherein the reel casing is pivotably coupled to the handle.

4. The retractable oxygen hose assembly of claim 3, wherein the reel casing is pivotable 180° around the handle.

5. The retractable oxygen hose assembly of claim 3, further comprising a retainer being coupled to the reel casing, the retainer being coupled to the handle wherein the retainer pivotably couples the reel casing to the handle.

6. The retractable oxygen hose assembly of claim 1, further comprising a reel spring being coupled to the reel, the reel spring being coupled to the first end of the tube, the reel spring winding around the reel when the reel rotates in the first direction to uncoil the tube for extension of the tube from the reel casing, the reel spring unwinding from the reel when the reel rotates in the second direction to coil the tube around the reel for retraction of the tube into the reel casing.

7. The retractable oxygen hose assembly of claim 6, wherein the reel spring has a spring tension, the spring tension increasing as the spring winds around the reel, the spring tension being released when the spring unwinds from the reel wherein the reel spring is configured to retract the tube into the reel casing.

8. The retractable oxygen hose assembly of claim 1, the locking pawl further comprising a main body and a finger extending downwardly from the main body, the finger contacting the ratchet when the locking pawl is pivoted downwardly to inhibit the ratchet from being rotated and the tube from being retracted into the reel casing, the finger being spaced from the ratchet when the locking pawl is pivoted upwardly.

9. The retractable oxygen hose assembly of claim 1, wherein the tube has a length between 12.2 meters and 18.3 meters.

10. The retractable oxygen hose assembly of claim 1, further comprising an axle being coupled to the platform, the pair of wheels being rotatably coupled to opposing lateral ends of the axle.

11. The retractable oxygen hose assembly of claim 10, further comprising a frame being coupled to the axle, the frame being positioned against a bottom side of the platform wherein the frame supports the platform.

12. The retractable oxygen hose assembly of claim 11, further comprising a support being coupled to the frame, the support extending downwardly from the frame, the support having a height being complementary to a height of the pair of wheels wherein the support is configured to support the platform levelly over a surface.

13. The retractable oxygen hose assembly of claim 12, the frame further comprising:

a frame first shaft extending outwardly from the axle; and a frame second shaft being spaced from the frame first shaft.

14. The retractable oxygen hose assembly of claim 13, the support further comprising:

a support primary pole being coupled to the frame first shaft, the support primary pole being perpendicular to the frame first shaft; and a support secondary pole being coupled to the frame second shaft, the support secondary pole being perpendicular to the frame second shaft.

15. A retractable oxygen hose assembly comprising:

a platform having a top side, a bottom side, a back edge, a front edge, and a pair of lateral edges, the top side being planar;

an axle being coupled to the bottom side of the platform, the axle being positioned on the back edge of the platform, the axle having a length exceeding a length of the back edge of the platform;

a pair of wheels being rotatably coupled to opposing lateral ends of the axle wherein each wheel of the pair of wheels is positioned adjacent to a respective lateral edge of the pair of lateral edges;

a handle being coupled to the axle, the handle extending upwardly from the axle, the handle being positioned adjacent to the back edge of the platform, the handle having a height between 0.91 meters and 1.5 meters wherein the handle is configured to facilitate a user gripping the handle to move the platform, the handle being spaced equidistantly from each wheel of the pair of wheels, the handle further including:

a handle first rod extending outwardly from the axle past the back edge of the platform;

a handle second rod being coupled to the handle first rod distally to the platform, the handle second rod extending upwardly from the handle first rod, the handle second rod being perpendicular to the handle first rod;

a handle third rod being coupled to the handle second rod distally to the handle first rod, the handle third rod extending outwardly away from the handle second rod wherein the handle third rod is configured to facilitate the user in gripping the handle, the handle third rod being angled upwardly and away from the handle second rod;

a grip sleeve being coupled to the handle third rod, the grip sleeve being hollow wherein the handle third rod is positioned within the grip sleeve;

a frame being coupled to the axle, the frame extending outwardly from the axle toward the front edge of the platform, the frame being perpendicular to the axle, the frame being coplanar with the axle, the frame being positioned against the bottom side of the platform wherein the frame supports the platform, the frame including:

a frame first shaft being positioned proximate to a first lateral edge of the pair of lateral edges;

a frame second shaft being spaced from the frame first shaft, the frame second shaft being positioned proximate to a second lateral edge of the pair of lateral edges;

a support being coupled to the frame, the support extending downwardly from the frame, the support having a height being complementary to a height of the pair of wheels wherein the support is configured to support the platform levelly over a surface, the support being positioned adjacent to the front edge of the platform, the support including:

a support primary pole being coupled to the frame first shaft, the support primary pole being perpendicular to the frame first shaft;

a support primary foot being coupled to the support primary pole distally to the frame first shaft, the support primary foot including a rubber material being configured to increase friction between the surface and the support primary pole wherein the support primary foot is configured to stabilize a position of the platform relative to the surface;

a support secondary pole being coupled to the frame second shaft, the support secondary pole being perpendicular to the frame second shaft;

a support secondary foot being coupled to the support secondary pole distally to the frame second shaft, the support secondary foot including the rubber material being configured to increase friction between the surface and the support secondary pole wherein the support secondary foot is configured to stabilize the position of the platform relative to the surface;

a bumper being coupled to the platform, the bumper being positioned on the front edge and each lateral edge of the pair of lateral edges of the platform, the bumper including a resiliently compressible material wherein the bumper is configured to inhibit the platform from damaging objects;

a reel casing being coupled to the handle, the reel casing having a front wall, a back wall, and a peripheral wall being coupled to and extending between the front wall and the back wall to define an interior space, the front wall being circular, the back wall being circular, the reel casing being spaced from the platform wherein the reel casing is suspended from the handle above the platform, the reel casing being pivotably coupled to the handle wherein the reel casing is pivotable 180° around the handle;

an aperture extending through the peripheral wall of the reel casing;

a reel being rotatably coupled to the reel casing, the reel being positioned within the interior space of the reel casing, the reel extending between the front wall and the back wall, the reel being centrally positioned relative to each of the front wall and the back wall;

a tube being coiled around the reel, the tube having a first end being coupled to the reel, the tube having a second end being distal to the first end, the second end being configured to be fluidly coupled to an oxygen source, the tube being outwardly extendable from the reel casing through the aperture, the reel being rotatable in a first direction to uncoil the tube for extension of the tube from the reel casing, the reel being rotatable in a second direction to coil the tube around the reel for retraction of the tube into the reel casing, the tube having a length between 12.2 meters and 18.3 meters wherein the tube is configured to transfer oxygen from the oxygen source to the reel casing whereby the tube is configured to facilitate the user in receiving oxygen from the oxygen source;

an adaptor port being coupled to the reel casing, the adaptor port extending through the front wall, the adaptor port being aligned with the reel wherein the adaptor port is fluidly coupled to the first end of the tube, the adaptor port being configured to be coupled to an oxygen hose to fluidly couple the oxygen hose to the tube;

a reel spring being coupled to the reel, the reel spring being coupled to the first end of the tube, the reel spring winding around the reel when the reel rotates in the first direction to uncoil the tube for extension of the tube from the reel casing, the reel spring unwinding from the reel when the reel rotates in the second direction to coil the tube around the reel for retraction of the tube into the reel casing, the reel spring having a spring tension, the spring tension increasing as the reel spring winds around the reel, the spring tension being released when the reel spring unwinds from the reel wherein the reel spring is configured to retract the tube into the reel casing;

a tube lock being coupled to the reel casing, the tube lock being releasably engageable with the tube wherein the tube lock selectively inhibits the tube from being extended or retracted relative to the reel casing, the tube lock including:

a pair of rollers being rotatably coupled to the peripheral wall of the reel casing, the pair of rollers being positioned on opposing edges of the aperture wherein the tube slides between the pair of rollers as the tube extends and retracts relative to the reel casing, the pair of rollers gripping the tube when the tube is pulled outward from the reel casing wherein the pair of rollers inhibit the tube from being retracted into the reel casing, the pair of rollers releasing the tube when the tube is pulled upward relative to the reel casing to retract the tube into the reel casing;

a ratchet being positioned in the interior space of the reel casing adjacent to the peripheral wall, the ratchet being coupled to the reel wherein the ratchet rotates in the first direction when the reel rotates in the first direction and wherein the ratchet rotates in the second direction when the reel rotates in the second direction;

a locking pawl being pivotably coupled to the reel, the locking pawl including:

a main body; and a finger being coupled to and extending downwardly from the main body, the finger contacting the ratchet when the locking pawl is pivoted downwardly to inhibit the ratchet from being rotated in the second direction and the tube from being retracted into the reel casing, the finger being spaced from the ratchet when the locking pawl is pivoted upwardly; and a ratchet spring being coupled to the reel, the ratchet spring being coupled to the locking pawl wherein the ratchet spring pivots the locking pawl upwards from the ratchet when the tube is pulled upward relative to the reel casing, the ratchet spring being biased to pivot the locking pawl downwardly toward the ratchet when the tube is pulled outwardly from the reel casing; and a retainer being coupled to the reel casing, the retainer being coupled to the handle wherein the retainer pivotably secures the reel casing to the handle, the retainer including:

a bracket being coupled to the handle, the bracket having a bracket wall and a pair of bracket lips being coupled to and extending forwardly from the bracket wall;

a reel casing projection being coupled to and extending outwardly from the reel casing, the reel casing projection being pivotably coupled to the bracket, the reel casing projection being positioned between the pair of bracket lips; and a fastener pivotably coupling the reel casing projection to the bracket.

* * * * *